US008281413B2

(12) United States Patent
Ly

(10) Patent No.: US 8,281,413 B2
(45) Date of Patent: Oct. 9, 2012

(54) SLIP LOCK GROMMET

(75) Inventor: John Thiet Ly, Richmond, CA (US)

(73) Assignee: The North Face Apparel Corp., Wilmington, DE (US)

( * ) Notice: Subject to any disclaimer, the term of this patent is extended or adjusted under 35 U.S.C. 154(b) by 378 days.

(21) Appl. No.: 12/652,308

(22) Filed: Jan. 5, 2010

(65) Prior Publication Data

US 2011/0162123 A1 Jul. 7, 2011

(51) Int. Cl.
*A41D 1/00* (2006.01)

(52) U.S. Cl. ..... 2/93; 24/115 R; 24/130; 24/458

(58) Field of Classification Search ..... 2/85, 93, 2/243.1; 24/115 R, 129 R, 130, 114.12, 713.6, 24/463, 662, 459
See application file for complete search history.

(56) References Cited

U.S. PATENT DOCUMENTS 2,786,208 A * 3/1957 Oberg ..... 2/232
3,147,526 A * 9/1964 Winson ..... 24/68 R
3,696,474 A * 10/1972 Slauta ..... 2/84
4,049,357 A * 9/1977 Hamisch, Jr. ..... 403/209
6,006,406 A 12/1999 Chung
2008/0155788 A1 7/2008 Robert

FOREIGN PATENT DOCUMENTS

JP 2006-068388 A 3/2006
KR 2019990040596 U 12/1999

OTHER PUBLICATIONS

International Search Report of PCT/US2010/049629 issued May 27, 2011 & Written Opinion.

* cited by examiner

*Primary Examiner* — Katherine Moran
(74) *Attorney, Agent, or Firm* — Kenyon & Kenyon LLP

(57) ABSTRACT

A grommet locking device, which combines the advantages of both a grommet and a cord lock in a single unitary device. The grommet locking device allows a user to tighten a cord with one hand. The grommet locking device includes a front piece having a locking mechanism and a back piece that are attached together with a piece of fabric therebetween. A cord is moveable within the locking mechanism between a first locked position and second unlocked position in order to tighten or loosen a portion of the garment, such as a hood of a jacket.

7 Claims, 5 Drawing Sheets

FIGURE 6
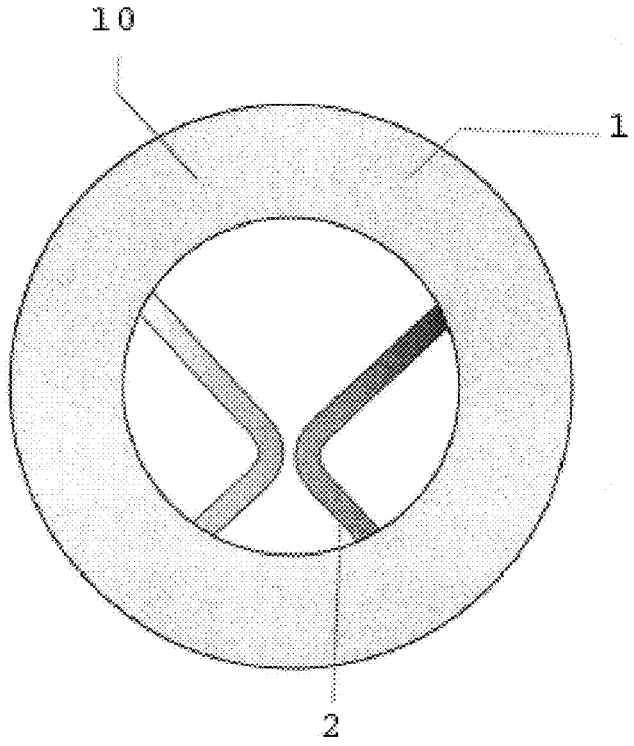
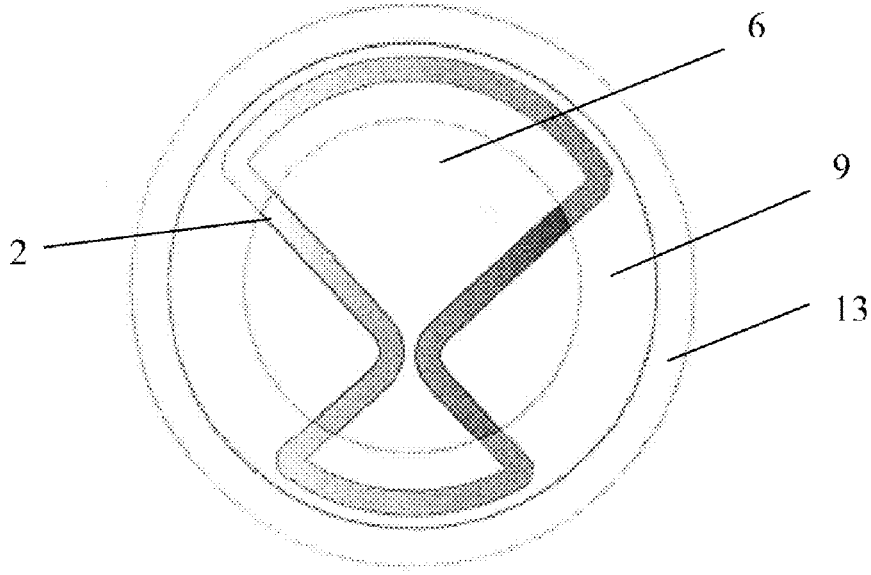
FIGURE 7

FIGURE 8A
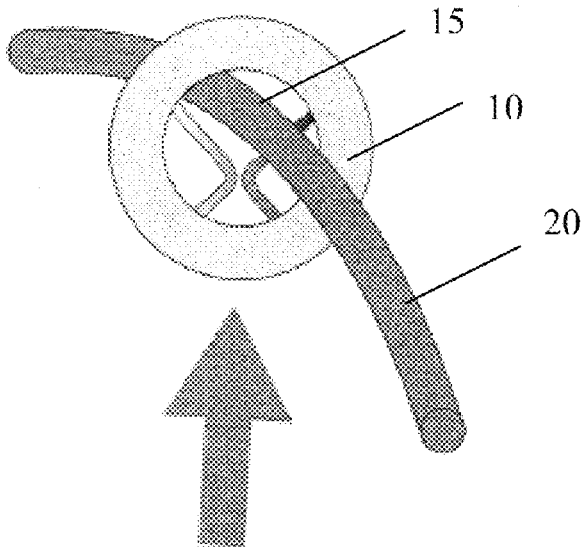
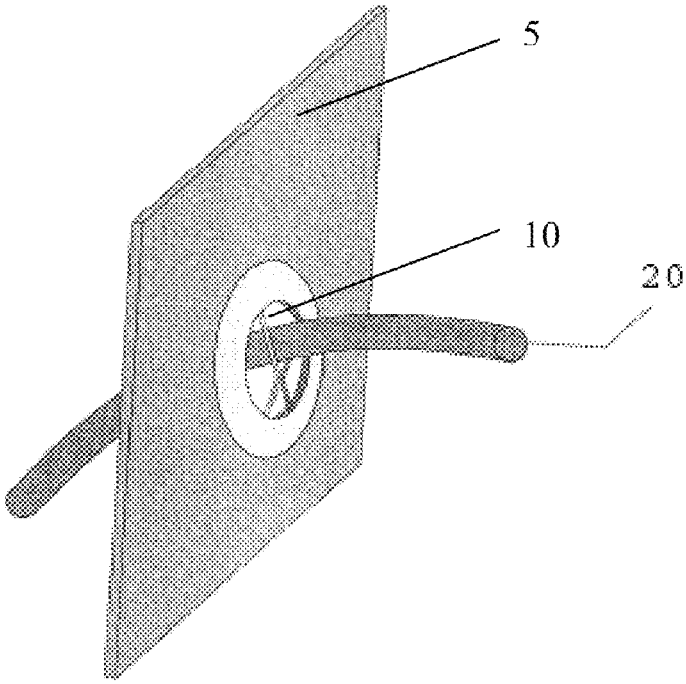
FIGURE 8B

FIGURE 9A
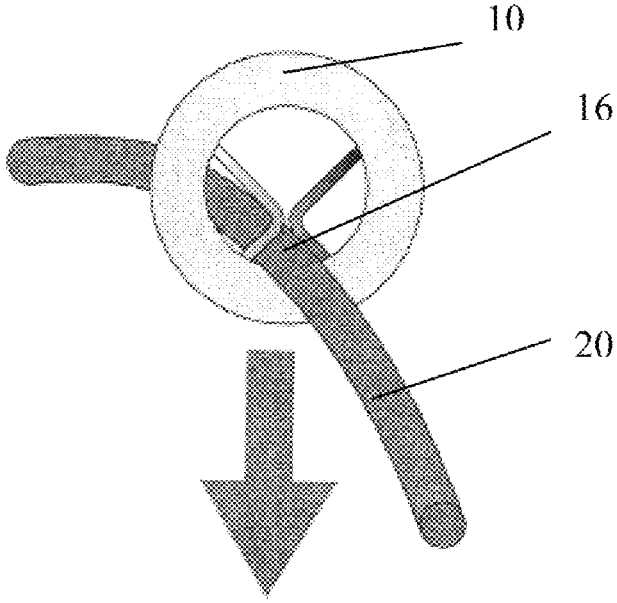
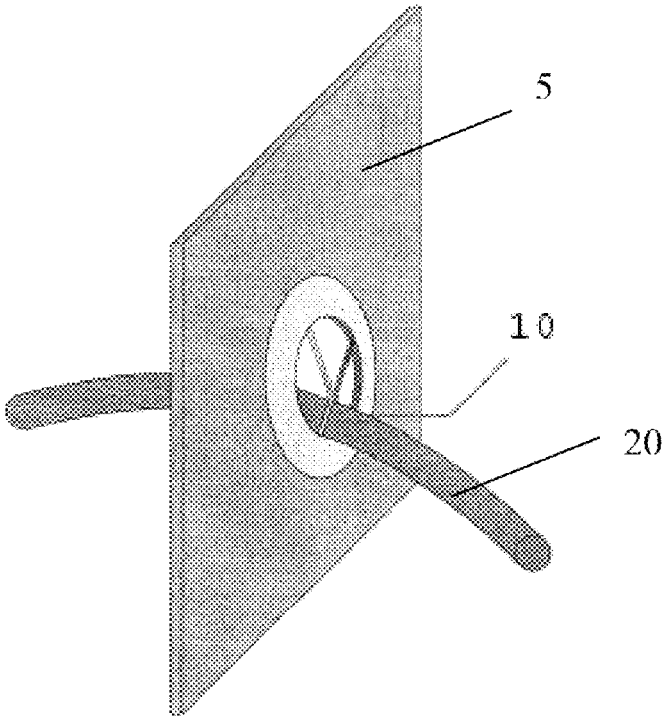
FIGURE 9B

SLIP LOCK GROMMET

FIELD OF INVENTION

The present invention relates to a cord lock system for use on a string, cord, or the like. Such device are particularly useful on drawstrings used on, for example, clothing, luggage, sporting gear, and shoes.

BACKGROUND

Cords or drawstrings are commonly used on articles of clothing, such as jackets, pants, shoes, luggage, such as backpacks or handbags, and sporting gear. For example, on hoods of jackets, including sweatshirts or fleeces, or on waistbands of sweatpants, shorts, swim trunks, or other garments, drawstrings are provided to allow the clothing to be drawn tightly around the user. Such drawstrings avoid the need for a belt or other additional tightening mechanism. Additionally on luggage, such as backpacks or purses, a drawstring may be provided for closing pockets or other openings.

The drawstring is usually housed in a tunnel provided in the seam of the fabric, and each end of the drawstring exits from the fabric through a hole. So that the edges of the hole do not fray or tear when the drawstring is pulled, a grommet is generally provided at these two exits to reinforce the holes. Such a grommet also allows for reduced friction when the cord is pulled through the hole.

In order to prevent the ends of the cord from being pulled inside the seam of the fabric, a knot is generally tied in the end of the cord. Additionally, to hold the cord in a tightened position, the two ends of the cord may be tied together. However, such tying may be difficult or inefficient, since both hands are required and is particularly difficult for small children. Alternatively, a cord lock can be provided on each end of the cord to hold the cord in the tightened position.

U.S. Pat. No. 6,658,704 to Buscart describes a cord lock 10 that can be secured to fabric 14. Cord lock 10 includes a body 16 having a pocket 30, an extension sleeve 18, and a back plate 24, that are joined together. A plunger 20 is provided in pocket 30 and includes a spring means 22. In order to adjust the cord 12 within the cord lock 10, the plunger is depressed by the user, such that the plunger hole 64 aligns with the holes 50 and 44 in the body. To lock the cord in place, the pressure on the plunger is simply released. Thus, this cord lock requires two hands to operate, one hand to adjust the cord and the other to depress the plunger.

U.S. Pat. No. 5,195,218 to Joseph et al. describes a flexible cord lock device formed as a single piece that can be affixed to a garment. Cord lock 10 is formed as a single piece of flexible plastic material with an aperture 26 for receiving the cord therethrough. To adjust the length of the cord 12, the ends of the cord lock 10 are compressed together to create a bulge which reduces the gripping force on the cord. In the embodiment of FIG. 6, a grommet 38 can be used together with the cord lock 10 to prevent loosening of the cord.

BRIEF DESCRIPTION

The prevent invention is a grommet locking device, which combines the advantages of both a grommet and a cord lock in a single unitary device. The grommet locking device of the present invention allows a user to tighten a cord with one hand.

BRIEF DESCRIPTION OF THE DRAWINGS

FIG. 6 is a front view of the grommet locking device of certain embodiments of the present invention.

FIG. 7 is a cross-sectional view of the grommet locking device of certain embodiments of the present invention showing the locking mechanism inside the front piece.

FIG. 8*a* shows the grommet locking device of certain embodiments of the present invention with a cord received therethrough in the unlocked position. FIG. 8*b* shows the grommet locking device with a cord in the unlocked position on a fabric 5, such as a garment.

FIG. 9*a* shows the grommet locking device of certain embodiments of the present invention with a cord received therethrough in the locked position. FIG. 9*b* shows the grommet locking device with a cord in the locked position on a fabric 5, such as a garment.

DETAILED DESCRIPTION

Figure 1:
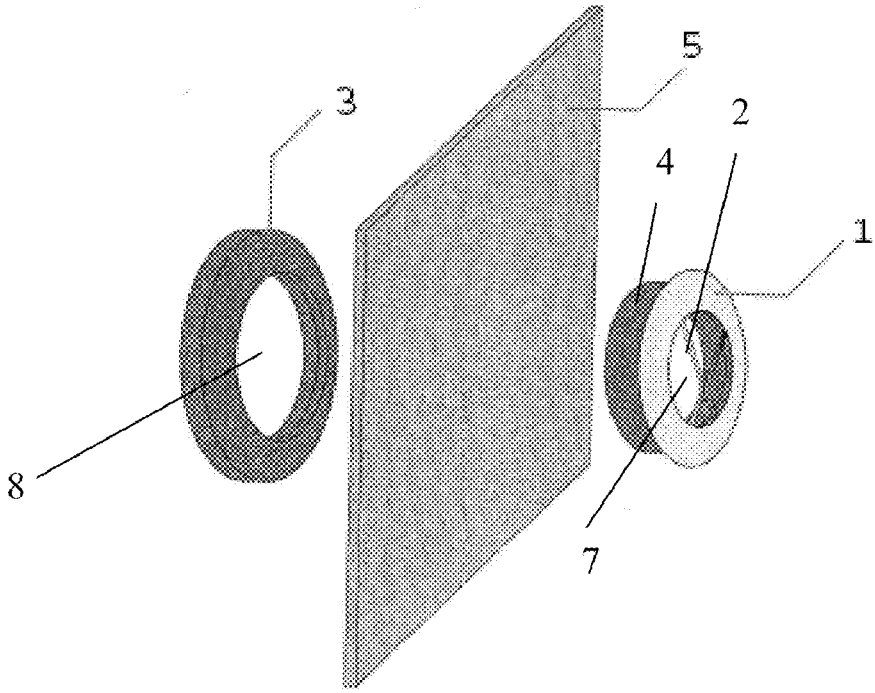
FIG. 1 shows the grommet locking device of certain embodiments of the present invention before the front piece and the back piece are attached together.
Figure 2:
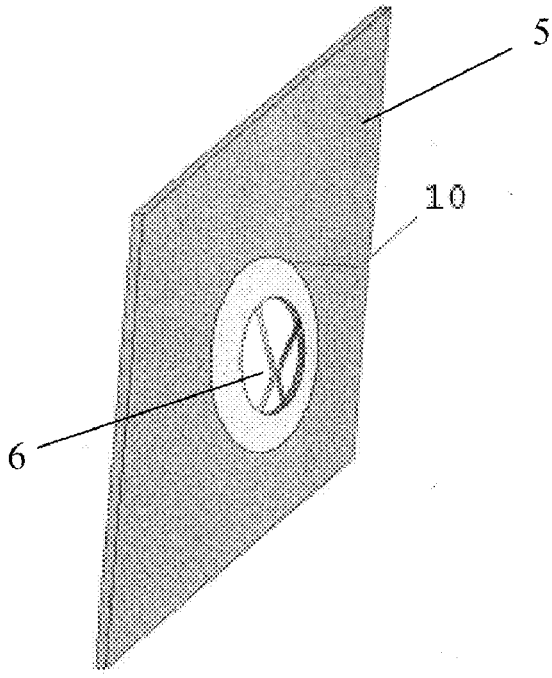
FIG. 2 shows the grommet locking device of certain embodiments of the present invention after the front piece and the back piece are attached together.

With reference to FIGS. 1 and 2, grommet locking device 10 (FIG. 2) includes front piece 1 and back piece 3, which are attachable to each other. Front piece 1 has a central opening 7 and an extension 4. Back piece 3 has a central opening 8 that is larger than the central opening 7 of the front piece 1. In FIG. 1, grommet locking device 10 is shown in its two separate pieces before it is attached to fabric 5. Although fabric 5 is shown as a single ply of fabric, it should be understood that fabric 5 can be multi-ply and can be of different thicknesses.

Also, in the examples shown, many of the components are annularly shaped (e.g., the front piece 1, back piece 3, extension 4, flange 21, and groove 9); however, it should be understood that these components may be any suitable shapes and/or sizes (e.g., square shaped).

Figure 3:
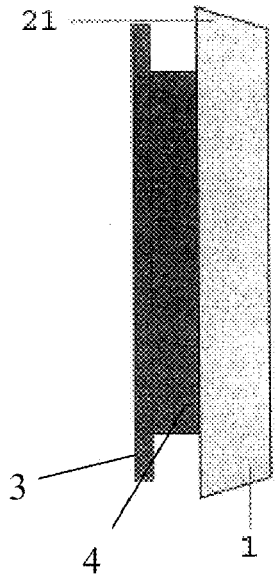
FIG. 3 shows a side view of the grommet locking device of certain embodiments of the present invention with the front piece and the back piece attached together without a piece of fabric therebetween.

As shown in FIG. 2, front piece 1 and back piece 3 are attached together to punch a hole 6 in fabric 5. Alternatively, fabric 5 can have hole 6 pre-cut therein and front piece 1 and back piece 3 can be attached within pre-cut hole 6. Hole 6 can be formed as an exit/entrance to a waistband, cuff or hood of clothing, a bag opening, or the like. Extension 4 is received through hole 6, and the distal end portion of extension 4 is received in central opening 8 in back piece 3. Extension 4 can be held within back piece 3 by a friction fit, an adhesive, or any other type of attachment means. FIG. 3 shows a side view of front piece 1 and back piece 3 attached together. Although in this embodiment, front piece 1 has an extension 4, alternatively back piece 3 can have an extension (not shown) that is attached to front piece 1 with similar means. The back surface of front piece 1 rests on the front of the fabric 5 forming a flange 21 (FIG. 3) that prevents the grommet locking device 10 from going completely through the hole 6.

Figure 4:
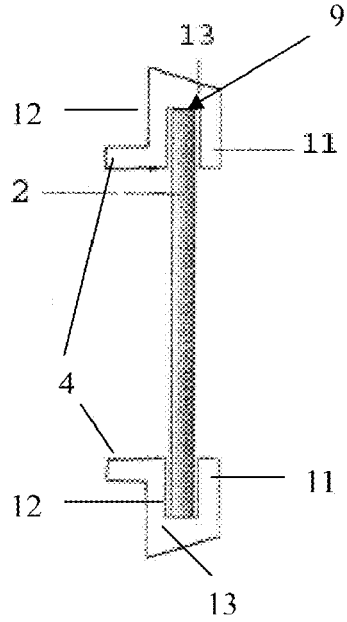
FIG. 4 shows a side cross-sectional view of the front piece of FIG. 3, showing the locking mechanism inside the front piece.

Located within the central opening 7 of front piece 1 is a locking mechanism 2 for locking a length of flexible material, such as a cord 20 therein. The locking mechanism 2 fits into a circumferential groove 9 in the flange 21 of front piece 1, as shown in the cross-sectional view of FIG. 4. The flange 21 has front flange portion 11, back flange portion 12, and side flange portion 13, which together form the groove 9 for receiving the locking mechanism 2. Extension 4 projects from back flange portion 12. FIGS. 6 and 7 show a front view of locking mechanism 2 received within front piece 1.

The locking mechanism can be made of a flexible material that has a spring-like qualities. These spring-like qualities allow the locking mechanism 2 to be compressed during placement in the groove 9, and to expand to hold locking mechanism 2 within the groove 9. Alternatively, the front piece can be manufactured around locking mechanism 2. The material comprising the locking mechanism 2 can include copper, a sheet metal alloy, nylon, acetal, or other flexible metal or plastic material.

Figure 5:
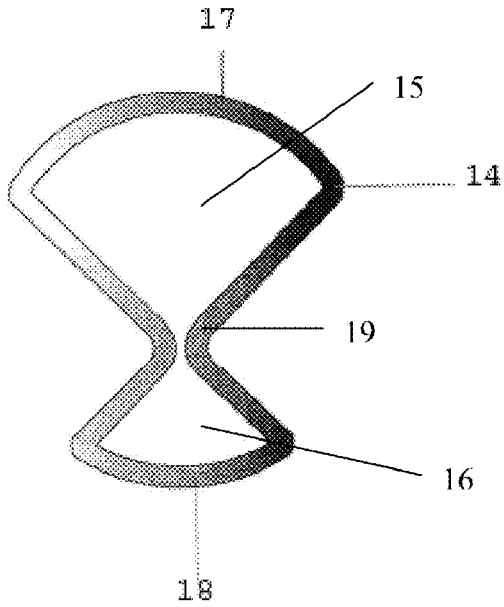
FIG. 5 is a front view of certain embodiments of the locking mechanism of the present invention.

In one embodiment, as shown in FIG. 5, the locking mechanism 2 is a unitary piece that has a substantially hourglass-shape 14 formed by two flexible arms. The hourglass shape 14 has a substantially triangular-shaped top opening 15 and a substantially triangular-shaped bottom opening 16. Top opening 15 has a curved top side 17 and bottom opening 16 has a curved bottom side 18, so that the top side 17 and the bottom side 18 fit into circumferential groove 9 of the front piece 1. Top opening 15 is preferably larger than bottom opening 16. Bottom opening 16 is sized equal to or slightly smaller than the circumference of cord 20, so as to receive cord 20 in a friction fit, as shown in FIGS. 9*a* and 9*b*. A portion of the inside surface of the locking mechanism may include grooves, teeth, or ridges (not shown) to act as a gripping surface for cord 20. Such a gripping surface may be provided only on the inner surface of the smaller bottom opening, or on any portion of the surface of the locking mechanism 2. Neck portion 19 is located between top opening 15 and bottom opening 16. Neck portion 19 has a space between the two sides of the hourglass shape 14, for passing the cord 20 therebetween when moving the cord 20 from an unlocked position to a locked position, or vice versa, as described below.

Although a hourglass-shape 14 of the locking mechanism 2 has been described above, any other shape that allows for a locking position and an unlocking position may be used. For instance, rather than two arms forming a substantially V-shaped configuration as shown, two arms could be curved more to form a substantially U-shaped configuration on either side. Although a unitary piece is shown in this embodiment, the locking mechanism can be formed from a plurality of separate pieces, such as two separate arms, which are joined to front piece 1.

FIGS. 8*a*, 8*b*, 9*a* and 9*b* shown the grommet locking device 10 in use. Cord 20 is received through hole 6, opening 7 and opening 8. FIGS. 8*a* and 8*b* show cord 20 in a first unlocked position. When a user wishes to adjust the length of the cord 20, the user pulls the cord 20 upwards so it sits within larger top opening 15. Since the opening 15 is larger than the outer dimensions of the cord 20, the cord will slide freely in this position, which is known as the first unlocked position. FIGS. 9*a* and 9*b* show cord 20 in a second locked position. When the user has adjusted the cord 20 to the desired length, the cord can be pulled down into the smaller bottom opening 16. Since the opening 16 is equal to or smaller that the outer dimensions of the cord 20, the cord 20 will be held tightly by a friction fit therein, which is known as the second locked position.

The grommet locking device of the present invention can be used, for example, on a jacket having a hood with a drawstring. In order to tighten the hood around the user's head, the user would pull the cord upwards to the unlocked position, tighten the cord, and then pull the cord downwards to the locked position. In order to loosen the hood, the user would pull the cord upwards to the unlocked position, loosen the cord, and then pull the cord downwards to the locked position. A similar method would be used on a drawstring on a waistband of pants or a jacket, or on pockets of luggage.

Cord 20 can be made of any flexible material, such as cotton, plastic, a woven material, a braided material, or any other textile. Cord 20 can further include an elastic material to allow stretching. Cord 20 is not limited to a round outer dimension, but can have any longitudinal shape, such as flat, rectangular or triangular. Cord 20 can include a plastic or metal tip on the ends thereof to prevent fraying of the ends.

The examples described herein are merely illustrative, as numerous other embodiments may be implemented without departing from the spirit and scope of the exemplary embodiments of the present invention. Moreover, while certain features of the invention may be shown on only certain embodiments or configurations, these features may be exchanged, added, and removed from and between the various embodiments or configurations while remaining within the scope of the invention. Likewise, methods described and disclosed may also be performed in various sequences, with some or all of the disclosed steps being performed in a different order than described while still remaining within the spirit and scope of the present invention.

What is claimed is:

1. A garment, comprising:

a length of flexible material;

a locking grommet device for receiving the length of flexible material therethrough, the locking grommet device comprising:

a front piece comprising a central opening and a locking mechanism mounted in the central opening for receiving the length of flexible material therethrough, wherein the front piece further comprises a flange for retaining the locking grommet device on the garment, wherein the flange comprises a groove for receiving the locking mechanism therein, and a back piece that is adapted to cooperate with the front piece to hold a piece of fabric therebetween; and wherein the length of flexible material is moveable within the locking mechanism between a first locked position and a second unlocked position in order to tighten or loosen a portion of the garment.

2. The garment of claim 1, wherein the front piece has a first central opening and the back piece has a second central opening, wherein the front piece further comprises an extension that is adapted to be received within the second central opening of the back piece, and wherein the flange is annular and has a diameter that is larger than the second central opening of the back piece.

3. The garment of claim 1, wherein the locking mechanism is a unitary piece that is bent into a substantially hourglass-shaped configuration, wherein the hourglass shape has a substantially triangular-shaped top opening and a substantially triangular-shaped bottom opening, and a neck portion therebetween.

4. The garment of claim 3, wherein the top opening is larger than the bottom opening.

5. The garment of claim 3, wherein the length of flexible material is a cord, and wherein the bottom opening is adapted to be slightly smaller that the outer diameter of the cord, such that the cord is in the first locked position when received therein.

6. The garment of claim 3, wherein the length of flexible material is a cord, and wherein the top opening is adapted to be larger than the outer diameter of the cord, such that the cord is in the second unlocked position when received therein.

7. A jacket, comprising:

a length of flexible material;

a locking grommet device for receiving the length of flexible material therethrough, the locking grommet device comprising:

a front piece comprising a central opening and a locking mechanism mounted in the central opening for receiving the length of flexible material therethrough, the front piece comprising a flange for retaining the locking grommet device on the garment; and a back piece that is adapted to cooperate with the front piece to hold a piece of fabric therebetween;

wherein the length of flexible material is moveable within the locking mechanism between a first locked position and a second unlocked position in order to tighten or loosen a portion of the garment, and wherein the flange comprises a groove for receiving the locking mechanism therein.

* * * * *